United States Patent [19]

Schultz

[11] Patent Number: 4,508,310

[45] Date of Patent: Apr. 2, 1985

[54] WALER BRACKET

[76] Inventor: Allan A. Schultz, Rte. 2, Box 79, New Richland, Minn. 56072

[21] Appl. No.: 534,123

[22] Filed: Sep. 20, 1983

Related U.S. Application Data

[63] Continuation of Ser. No. 389,859, Jun. 18, 1982, abandoned.

[51] Int. Cl.[3] ..... E04G 17/06

[52] U.S. Cl. ..... 249/189; 249/45; 249/219 W

[58] Field of Search ..... 249/219 W, 45, 18, 189, 249/192

[56] References Cited

U.S. PATENT DOCUMENTS

| | | | |
|---|---|---|---|
| 1,757,321 | 5/1930 | MacDonald | 249/219 R |
| 2,217,278 | 10/1940 | Kanter | 249/219 W |
| 2,237,366 | 4/1941 | Schlatter | 249/219 W |
| 2,879,576 | 3/1959 | Imonetti | 25/131 |
| 3,347,510 | 10/1967 | Buyken | 248/205 |
| 3,548,398 | 12/1970 | Furr et al. | 249/219 |
| 3,584,827 | 6/1971 | Shoemaker | 249/45 |
| 3,655,162 | 4/1972 | Shoemaker | 249/219 |
| 3,712,576 | 1/1973 | Dagiel | 249/192 |
| 3,724,806 | 4/1973 | Shoemaker | 249/219 |

*Primary Examiner*—Jay H. Woo
*Assistant Examiner*—James C. Housel
*Attorney, Agent, or Firm*—Schroeder, Siegfried, Vidas & Arrett

[57] ABSTRACT

A waler bracket for use with a concrete wall form. The waler bracket includes a main frame portion attached to a stud projecting from the wall portion and a captive wedge portion for forcing the waler into firm contact with the face of the panel.

1 Claim, 4 Drawing Figures

WALER BRACKET

This is a continuation of application Ser. No. 389,859, filed June 18, 1982 now abandoned.

DESCRIPTION

BACKGROUND OF THE INVENTION

1. Field of the Invention

The present invention relates generally to a waler bracket and, more particularly, pertains to a waler bracket for use with a concrete wall form.

2. Description of the Prior Art

A number of waler brackets or clamps have appeared in the prior art for securing concrete wall forms in place. The panels used in the molds are maintained in longitudinal alignment by means of relatively heavy stringers or walers which extend horizontally across the panels while bearing against the vertical members. The walers generally have associated therewith means for wedging the walers firmly against the panels to keep them straight with respect to each other.

U.S. Pat. No. 2,879,576 shows a waler clamp which forces a heavy stringer against a vertical frame bar by using a wedge to exert force on a tie rod secured to the vertical member.

U.S. Pat. No. 3,547,398 shows a different form of bracket for use in constructing concrete forms held in a spaced relationship by ties. The brackets shown in the patent are generally used in association with specific tie members also shown.

U.S. Pat. No. 3,347,510 shows a waler bracket which is secured to the panel to be straightened by a tie rod, and the wedging force is applied by driving a nail into an aperture to force a portion of the bracket into contact with the waler to force it against the panel surface.

U.S. Pat. No. 3,584,827 pertains to a three-part waler clamp assembly which is secured to a vertical marginal frame member and tie rod.

U.S. Pat. No. 3,655,162 relates to a waler clamp for application to the protruding end of a tie rod to securely clamp a waler against the outer side of a series of upstanding edge-to-edge wall form panels. U.S. Pat. No. 3,724,806 is another form of the same waler clamp.

U.S. Pat. No. 3,712,576 relates to a waler clamping assembly which, in one form, is applied to steel studded concrete wall form panels to clamp walers in position against the panels and, in another form, is directly applied to the waler to clamp a pair of strongbacks against the waler.

My improved bracket is less complex than the prior art brackets and is, therefore, simpler to manufacture and easier to use than brackets according to the prior art.

SUMMARY OF THE INVENTION

The general purpose of the present invention is to provide a waler bracket which can be easily manufactured and installed to secure a waler against vertical panels used in concrete wall forms.

The waler bracket or clamp has a frame with a first substantially vertical portion constructed and arranged for engaging at least one stud projecting from the face of a panel. The frame has a substantially horizontal central portion constructed and arranged for supporting a waler and a second substantially vertical portion on the opposite side of the central portion from the first portion. The central portion of the frame also includes a slot for receiving a wedge inserted therein.

The waler clamp also includes a wedge arranged for insertion through the slot in the central portion of the frame between the second portion of the frame and the face of the waler to force the waler into aligning contact with the panel.

DETAILED DESCRIPTION OF THE INVENTION

Figure 1:
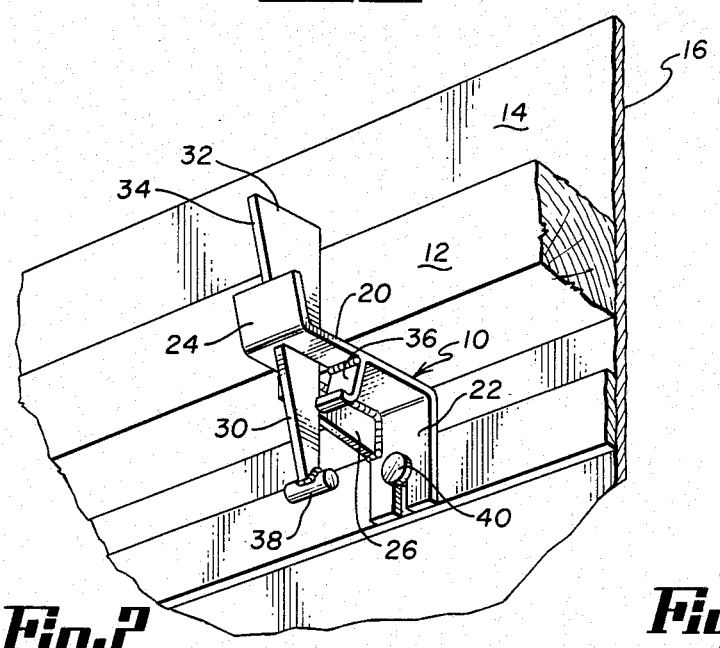
FIG. 1 is a perspective view illustrating a perferred embodiment of the present invention mounted for securing a waler against a planar surface.
Figure 2:
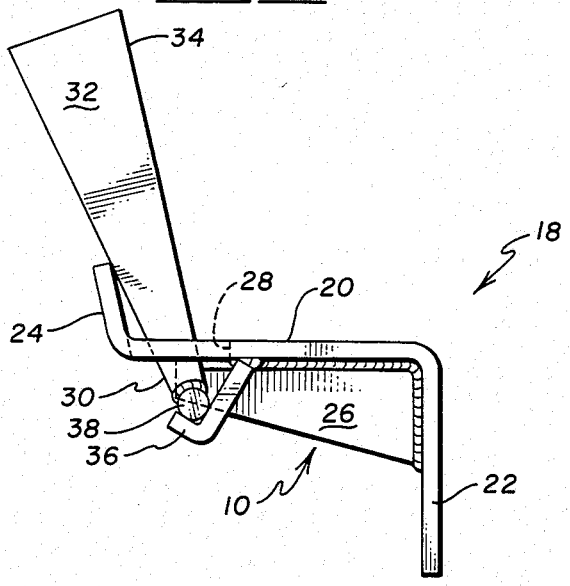
FIG. 2 is a side view of a waler bracket according to the present invention.
Figure 3:
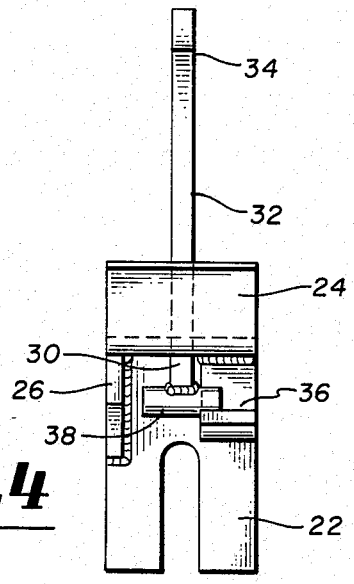
FIG. 3 is a front view of the clamp.

FIG. 1 shows a clamp 10 mounted for securing a waler 12 against the face 14 of a panel 16. The waler clamp 10 is comprised of a main frame means 18 which has a substantially horizontal central portion 20 and a first vertical portion 22 and a second vertical portion 24 at opposite ends thereof. A reinforcing piece or gasset 26 is welded to the bottom of frame 18, serving to reinforce the frame and prevent a change in the angle between the substantially horizontal portion 20 and the substantially vertical section 22. The central portion 20 of the frame 18 includes a slot 28 which is constructed and arranged to receive the narrow portion 30 of a wedge 32. The widest portion 34 of wedge 32 has a width which exceeds the length of slot 28. Wedge 32 has a thickness slightly less than the width of slot 28. An L-tab 36 is welded to the underside of the frame 18 and is aligned with slot 28 to receive the narrowed portion 30 of wedge 32 as shown in FIG. 2. The wedge 32 also includes a cylindrical tip portion or wedge keeper 38 which is welded to the narrowed portion 30 to retain wedge 32 in slot 28 and provide a larger bearing surface for the tip 30 of wedge 32 in the keeper 36.

L-tap or flanged means 36 is mounted below slot 28 for receiving the wedge keeper 38 which is welded to the wedge means 32 while permitting wedge means 32 to be readily moved from the flange means 36 in a non-engaging movement with waler 12, to an operable position in which the wedge means 32 engages the waler 12 along its surface opposite the one engaging face 14 of panel 16.

Figure 4:
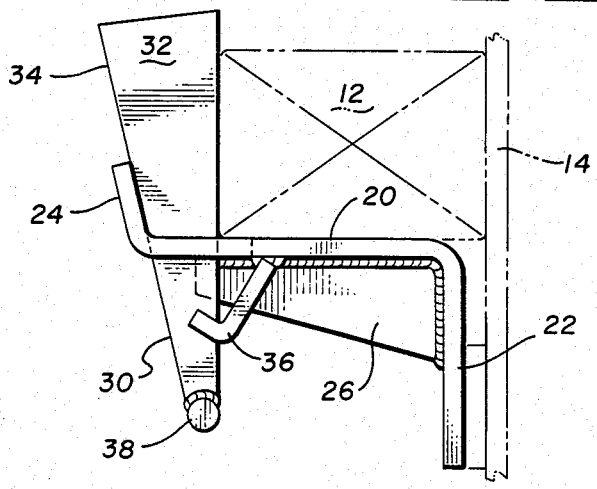
FIG. 4 is a side view of a clamp securing a waler against a planar panel.

FIGS. 1 and 4 show the clamp in use securing a waler 12 to a panel 16. The wedge 32 is angled to bear against the substantially vertical lip 24 of the frame 18 and against the outside edge of waler 12. The wedge is driven firmly into the slot 28 and thereby applies a substantial force against the face of waler 12. Because frame 18 is anchored by stud 40 to the panel, the waler is secured to the panel by the wedging force. A series of waler clamps 10 can be utilized on adjacent panels to align a waler with the panel face and thereby straighten the panels and hold them in a desired alignment.

What is claimed is:

1. In combination with a plurality of vertical panels arranged in a side-by-side edge abutting array, said panels interconnected by joining means mounted on studs projecting from the face of adjoining panels, a plurality of waler bracket clamps for securing a waler to the faces of said panels and aligning the faces of said panels into a common plane, each of said brackets comprising, in combination:

frame means having a first substantially vertical portion constructed and arranged to releasably engage at least one stud projecting from the face of one of said panels, and a substantially horizontal central portion constructed and arranged for supporting a waler and a second substantially vertical portion on the opposite side of said central portion from said first vertical portion, said central portion including a slot therein disposed from said first substantially vertical portion, said central portion of said frame means including a flanged means mounted below said slot for receiving a keeper bar attached to a wedge means while permitting said wedge means to be readily moved from said flanged means in a non-engaging movement to an operable position in which the wedge means engages the waler; and said wedge means having a narrow portion inserted into said slot for forcing the waler flush against the face of the panel thereby aligning the face of the panel with the edge of the waler, said keeper bar attached to said narrow portion of said wedge means transversely to said slot for retaining said wedge means in said slot.

* * * * *